US006551096B2

(12) United States Patent
Saito et al.

(10) Patent No.: US 6,551,096 B2
(45) Date of Patent: Apr. 22, 2003

(54) IGNITION MECHANISM FOR GAS LIGHTER

(75) Inventors: Masaki Saito, Shizuoka-ken (JP); Toshihiro Ichikawa, Shizuoka-ken (JP)

(73) Assignee: Tokai Corporation, Tokyo (JP)

( * ) Notice: Subject to any disclaimer, the term of this patent is extended or adjusted under 35 U.S.C. 154(b) by 0 days.

(21) Appl. No.: 09/928,931

(22) Filed: Aug. 13, 2001

(65) Prior Publication Data

US 2002/0039712 A1 Apr. 4, 2002

(30) Foreign Application Priority Data

Oct. 3, 2000 (JP) ..... 2000-303481
Dec. 28, 2000 (JP) ..... 2000-402448

(51) Int. Cl.[7] ..... F23Q 2/46
(52) U.S. Cl. ..... 431/153; 431/277
(58) Field of Search ..... 431/153, 277

(56) References Cited

U.S. PATENT DOCUMENTS 5,104,313 A 5/1992 Zellweger
5,547,370 A 8/1996 Hwang
5,759,023 A 6/1998 Jenlis
5,868,561 A 2/1999 Rogelet
5,913,674 A 6/1999 Shimizu
5,971,749 A 10/1999 Chen
5,997,281 A 12/1999 Lei
6,053,727 A 4/2000 Potskhishvili et al.
6,074,198 A 6/2000 Rogelet
6,146,128 A * 11/2000 Feng et al. ..... 431/153
6,168,421 B1 * 1/2001 Hsieh ..... 431/153
6,220,853 B1 * 4/2001 Luo ..... 431/153
6,352,429 B1 * 3/2002 Sher ..... 431/153
2002/0155407 A1 * 10/2002 Li ..... 431/153

FOREIGN PATENT DOCUMENTS

JP 2001-272034 A * 10/2001

* cited by examiner

*Primary Examiner*—Sara Clarke
(74) *Attorney, Agent, or Firm*—Baker Botts LLP

(57) ABSTRACT

A flint-type ignition mechanism comprising a freely rotatable support member; a spark wheel combined with the supporting member so as to be integrally rotatable with same; an elastic member installed around the support member; a thumb wheel having a gear-type inner face installed around the elastic member so that it can idle, the thumb wheel switching between the concentric and eccentric position; and a disk-shaped engaging member which rotates together with the supporting member and has engagement stoppers on the peripheral surface of the exterior circumference thereof for engaging the gear type inner face of the thumb wheel. When the thumb wheel is switched to the eccentric position by a deformation of the elastic member, the stoppers engage together and the spark wheel rotates together with the thumb wheel, causing it to be in the ignite-state. In the ignite-state, rotation of the thumb wheel rotates the spark wheel for ignition.

8 Claims, 16 Drawing Sheets

IGNITION MECHANISM FOR GAS LIGHTER

BACKGROUND OF THE INVENTION

1. Field of the Invention

The present invention relates to an ignition mechanism for a gas lighter that uses flint and makes sparks by rotating the spark wheel, and in particular to an ignition mechanism having a non-ignite state implemented by idling the thumb wheel.

2. Description of the Related Art

Some prior art ignition mechanisms having thumb wheels have been proposed, wherein the thumb wheel is separated from the spark wheel so that the thumb wheel can idle. Moreover, the spark wheel can not be rotated by simply rotating the thumb wheel, rendering these ignition systems impossible to ignite, so as to prevent unintentional ignition of a flame.

Such ignition mechanisms for gas lighters are disclosed in U.S. Pat. Nos. 5,547,370, 5,759,023, 5,868,561, 5,913,674, 5,971,749, 5,997,281, 6,053,727, and 6,074,198. These systems comprise ignition mechanisms in which two faces, one of the thumb wheel and one of the spark wheel are caused to mesh by pushing and rotating the thumb wheel, and caused to make sparks by the power of a finger being transferred to the spark wheel. If the thumb wheel is not pushed so that it is against the spark wheel, the ignition mechanism will not ignite and the thumb wheel idles. Various meshing-mechanism types have been proposed.

Further, a system that controls the rotation of a thumb wheel and the meshing-conjugation of a thumb wheel and a spark wheel by elastic members is disclosed in U.S. Pat. No. 5,104,313.

However, said prior art ignition mechanisms for gas lighters have problems as stated below, which are improved upon in the present invention.

First, the prior art ignition systems have problems related to their operation. In short, the ignition mechanisms ignite by making sparks caused by rotation of the spark wheel, dependent on meshing two parts having determined shapes, or friction, and do not ignite if the spark wheel is not rotated. Therefore, if the distinction between the ignite-state and the not-ignite state is not clear, the operability becomes unstable. For example, if it is not possible to positively detach the meshing mechanism in the non-ignite state between the thumb and spark wheels, it is impossible to recognize whether or not it has been switched to the ignite-state by pushing the thumb wheel, etc., and it operates over and over again in the non-ignite state. Also, in the ignition mechanism dependent solely on friction, the required push-operating force varies due to the influence of gear form of the spark wheel, hardness of the flint, etc., and the switch to an ignite-state becomes unclear, resulting in the same problem with respect to operation as the mechanism described above. On the other hand, the latter prior art have clutch-connection structures utilizing an elastic member, which serves to slide the thumb wheel on axis, so its operating method is different from ordinary operating method and operating it is unnatural and difficult.

Next, regarding assembly, the prior art ignition systems are structured so that the thumb wheel and spark wheel are caused to turn as a unit by pushing together and engaging different sized shapes. Because a gap dimension is incorporated into the design to provide for a disengaged state in which the ignition mechanism is in the normal, non-ignite state, the thumb wheel is shaky, and assembly is unstable, resulting in a product that appears to be defective and that has lower merchandising value. Also, in general, metal material is used for the spark wheel, the shaft and the thumb wheel because of its hardness and heat resistance. Therefore, if the above gap is large, when the ignition system is in the non-operate state, its metal members crash against each other and make noise, giving the lighter a poor impression as a product.

In view of the points described above, the present invention provides an ignition mechanism for a gas lighter with improved operability wherein the thumb wheel can idle, and the assembly is sure, not shaky, and the thumb wheel thereby providing a product with improved appeal.

SUMMARY OF THE INVENTION

The ignition mechanism for a gas lighter according to the present invention which solves the aforementioned problems makes sparks upon rotation of a spark wheel against which a flint is being held under pressure thereby, comprising: a shaft-shaped support-member rotatably installed in the body of the lighter, a spark wheel united with said supporting member so that it can rotate, an elastic member installed around the outside periphery of the support member on one or both sides of the spark wheel, a thumb wheel, on whose inner circumference is formed a gear-type face, installed on the outer circumference of said elastic member so that it can rotate, and can travel between the concentric position and the eccentric position with respect to the aforementioned support member by deformation of said elastic-member, a polygonal or disk-shaped engaging member installed on the inner circumference of the gear-type inner face of aforementioned thumb wheel so that it can be united with aforementioned support member and rotate, having a gear-type outer face smaller in size than said gear-type inner face of A said thumb wheel which can engage with said gear-type inner face by switching said thumb wheel to the eccentric position, wherein, when said thumb wheel is in the concentric position with respect to the support member by the elastic force of the elastic member, its engaging-stopper and engaged- member of engaging member do not engage and said thumb wheel is idled, and said thumb wheel switches to eccentric position upon deformation of the elastic member, and said spark wheel is made to rotate upon engagement of the gear-type inner face of the thumb wheel and the gear-type outer face of the engaging member by rotation of said thumb wheel.

It is preferable that said support-member have a conjoining part fitted and fixed to the center hole of the spark wheel from either side, and a shaft part around which said elastic member is installed. Further, said support member can be constituted so that on one side the engaging member is integrally formed therewith, which then penetrates through the spark wheel and thumb wheel, and the engaging member on the other side is secured to the other end thereof. It is also preferable that, adjacent to said conjoining part said engaging-member is integrally formed with said support-member, and that said elastic-member is installed between the side the spark wheel and said engaging-member. Further, said elastic member may be installed on the outside of said engaging member. It is preferable that said engaging-member is inserted into the concave part having a larger outside diameter than the engaging-member formed on the outer or inner side of the thumb wheel, and said gear-type inner face is formed on the inside circumference of said concave part.

It is preferable that the inner circumference of said elastic-member is in contact with said support-member, and that the outer circumference of said elastic-member can come in contact with the inner face of said thumb wheel, and that it is composed of an elastic material, such as rubber or soft resin, or a spring material, such as metal or resin.

According to the present invention described above, the elastic-member mounted around the support member that can rotate as a unit with the spark wheel provides for the ability of the thumb wheel to be idled, as well as to be switched between the eccentric and concentric positions with respect to the support member, and the thumb wheel is provided, on a part of its inner circumference, with a gear-type inner face capable of engaging with the gear-type outer face of the engaging-member so that they can be rotated as a unit with the support-member, and wherein when the thumb wheel is in the concentric position with respect to the support member, the gear-type inner face and the gear-type outer face do not engage, and the thumb wheel is idled, and when the thumb wheel is moved to the eccentric position the spark wheel can be caused to rotate by rotation of the thumb wheel to and therefore, the spark wheel does not turn simply by rotation of the thumb wheel as per a conventional operation, and a non-ignite state is provided by causing the thumb wheel to run idle, and the desired function is attained. Operability is improved as the ignition system of the present invention is operated to generate sparks by pushing and rotating the thumb wheel based on utilization of two meshing faces which provide surity in distinguishing whether the ignition mechanism is coupled so as to provide sparks or not, that is to say, whether the thumb wheel is idled or engaged, compared to reliance on friction as in conventional ignition mechanisms which are effected by hardness of the flint, the surface condition of the spark wheel, etc.

Also, by employment of elastic members, the gap size between the thumb wheel and the support members, and the spark wheel is reduced, eliminating shakiness and providing stable assembly. Moreover, when the thumb wheel idles, meshing points do not crash against each other and make noise, providing for smooth rotation and eliminating the possibility that the product be thought to be defective, thereby improving its merchandising appeal.

DESCRIPTION OF THE PREFERRED EMBODIMENT

Figure 1:
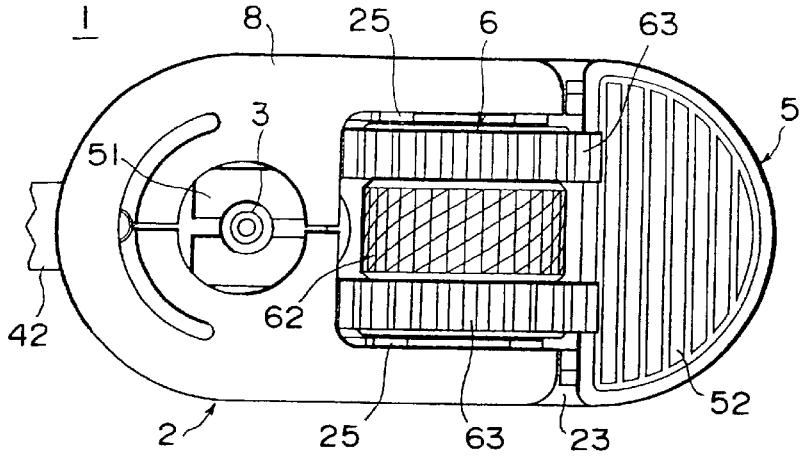
FIG. 1 is a top view of the gas lighter having the ignition mechanism of an embodiment of the present invention in the non-operating state.
Figure 2:
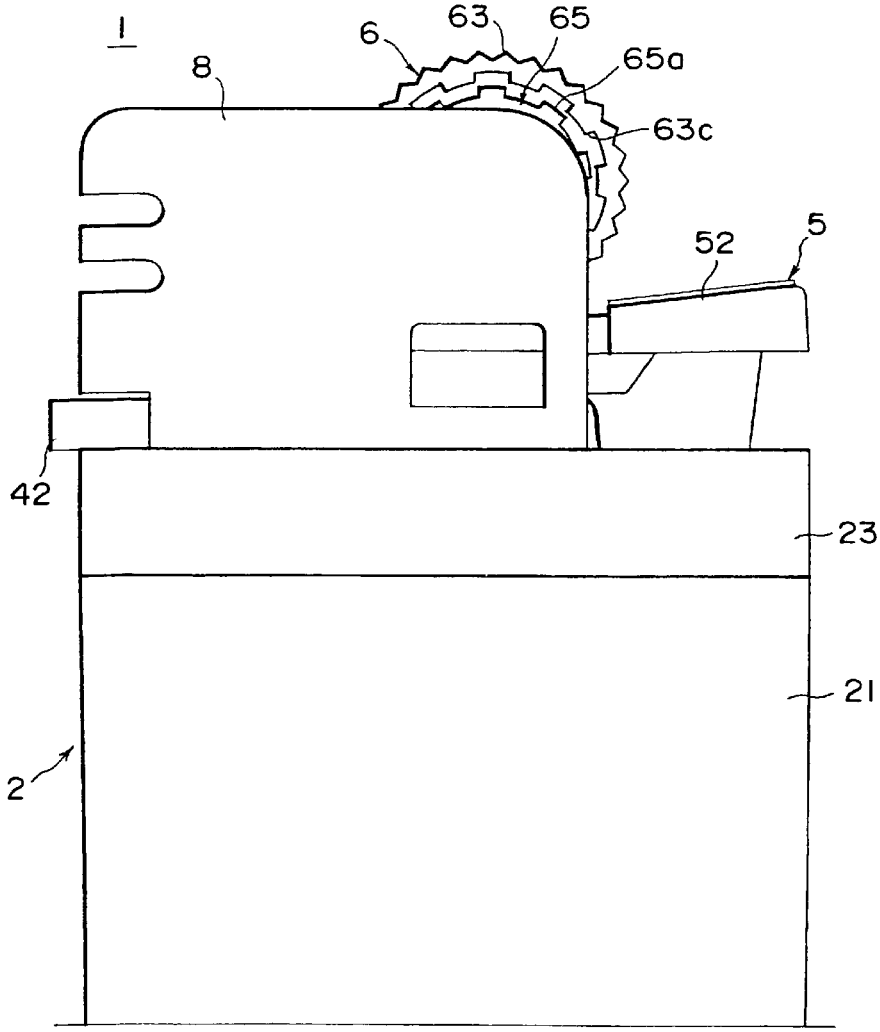
FIG. 2 is a side view of the lighter of FIG. 1.
Figure 3:
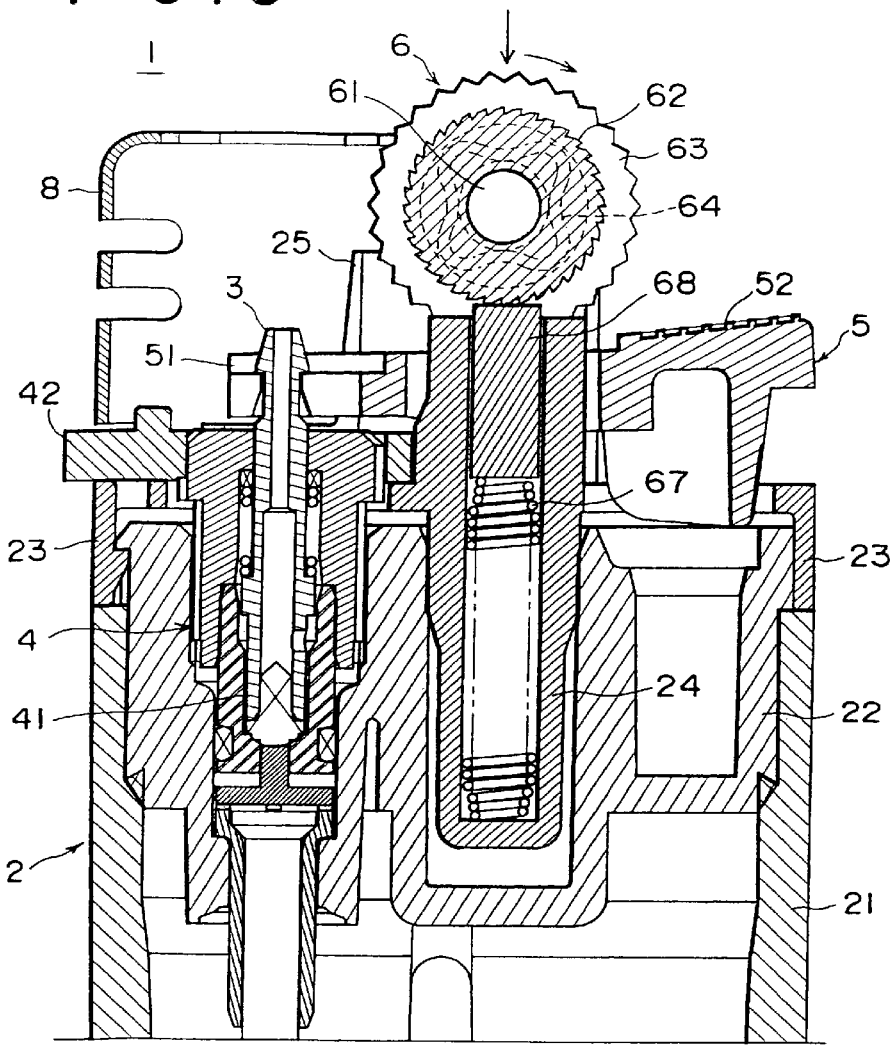
FIG. 3 is a central cross-sectional view of FIG. 1.
Figure 4:
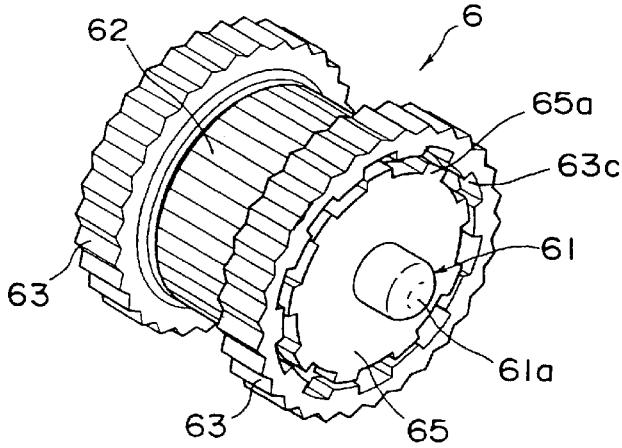
FIG. 4 is a perspective view of the ignition mechanism in assembling state of FIG. 1.
Figure 5:
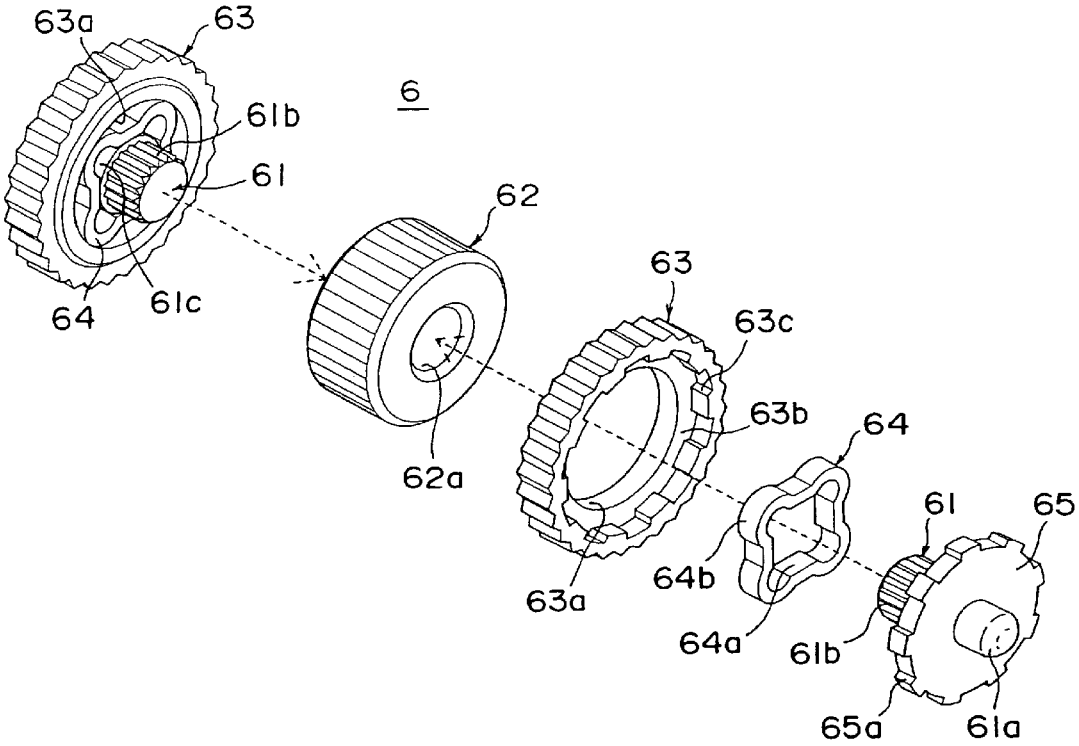
FIG. 5 is an exploded perspective view of FIG. 4.
Figure 6:
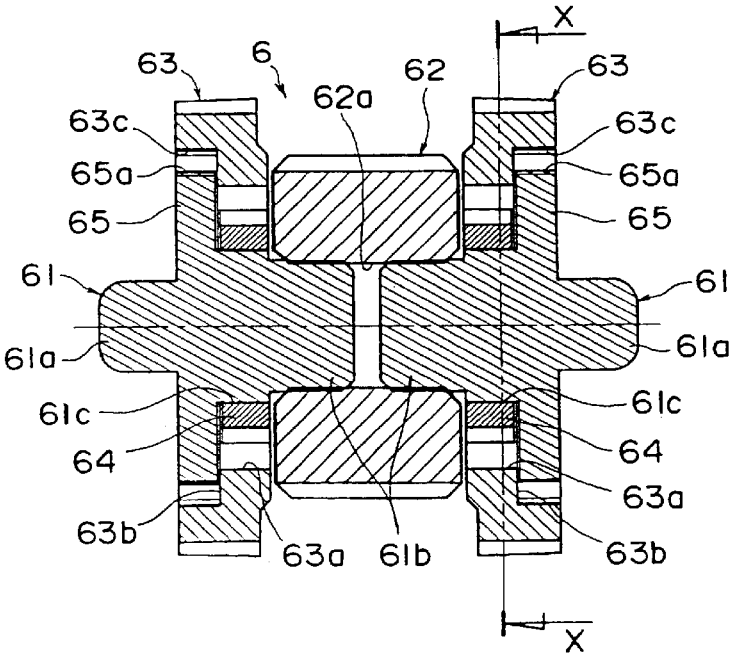
FIG. 6 is a central cross-sectional view of the ignition mechanism part of FIG. 1, FIGS. 7A to 7D are cross-sectional views of structural parts of the ignition mechanism parts in sequential operating states taken along the line X—X of FIG. 6, FIGS. 8A to 8D are side views of the structural parts of the ignition mechanism in sequential operating states.

Following is a description explaining in detail a preferred embodiment of the ignition mechanism according to the present invention referring to the drawings. FIG. 1 is a top view of a gas lighter having the ignition mechanism of an embodiment of the present invention in the non-operating state, FIG. 2 is a front view, FIG. 3 is a central cross-sectional view of FIG. 1, FIG. 4 is a perspective view of the ignition mechanism in its assembled state, FIG. 5 is an exploded perspective view of FIG. 4, and FIG. 6 is a central cross-sectional view of the ignition mechanism part of FIG. 1. FIGS. 7A to 7D are cross-sectional views taken along line X—X of FIG. 6 which show the ignition mechanism in its sequential operating-states, and FIGS. 8A to 8D are front views thereof.

The gas lighter 1 is equipped with a body 2 in which fuel gas is stored, a nozzle 3 which spouts fuel gas, a fuel supply means 4 (shown in FIG. 3) having a valve system 41, an operating lever 5 which pulls the nozzle 3 of the fuel supply means 4 up to provide for opening and closing of the valve system, and a flint (spark type) ignition mechanism 6.

The body 2 is composed of a synthetic resin tubular tank 21 on whose upper face (shown in FIG. 3), an upper lid 22 is fixed in an airtight manner, the interior of which stores fuel gas, e.g. butane gas, etc., and an inner-case 23 fixed on its upper section separately.

The fuel supply means 4 is composed of a valve system 41, which is well known, installed on the upper lid 22 of said body for controlling the amount of the stored fuel to be spouted, and the nozzle 3 installed at the center of said valve system 41 and protruding into the upper part from the inner-case 23, further having an engaging-part 51 formed at the edge of, and interlocking with said operating lever 5. Also, a cap 8 is mounted on the upper circumference of said nozzle 3, and a flame-adjusting knob 42 for adjusting the amount of fuel gas spouted from nozzle 3 is also provided.

As shown in FIG. 4 to FIG. 6, the ignition mechanism 6 is composed of supporting members 61 and 61 installed on both edges of the ignition mechanism, a spark wheel 62 having its circumference formed as a spark face fixed on said supporting members 61 and 61, ring-shaped thumb wheels 63 and 63 which can idle, installed on both sides of said spark wheel 62, elastic members 64 and 64 installed on the peripheries of supporting members 61 and 61 inside of thumb wheels 63 and 63, disc-shaped engaging-members 65 and 65 which turn as a unit with supporting members 61 and 61 outside of thumb wheels 63 and 63, and the flint 68 pressed to the bottom section of said spark wheel 62 by stone-spring 67 (shown in FIG. 3). The flint 68 and stone-spring 67 are installed in a tube portion 24 of said inner-case 23.

The disc-shaped engaging-members 65 form an integral unit with their respective counterpart supporting members 61, and gear-shaped stoppers 65*a* are provided on the peripheries of engaging members 65. A shaft-shaped conjoining part 61*b* composed of a gear-shaped rolet extending to the exterior face along an axis protrudes from the center of the interior face of engaging member 65, a shaft part 61*c* having a smooth peripheral surface is installed between the shaft-shaped conjugation part 61*b* and the engaging-member 65, and a rotating shaft 61*a* protrudes from the center of periphery of the engaging-member 65. The shaft-shaped conjoining part 61*b* of both supporting members 61 are fitted in and interlocked with the tube-shaped center hole 62*a* of the spark wheel 62 from both sides so that they rotate as a unit. Also, the protruding rotating-shaft 61*a* is inserted into and supported by the bearing hole (not shown FIG.) opened in supports 25 installed on the right and left sides of said inner-case 23, and the spark wheel 62 is installed so that it can rotate. Thereby, sparks are generated by the rotation of said spark wheel 62 rubbing against the flint 68.

Note that said engaging members 65 may be formed separately from supporting members 61 and integrated by being fixed to each other.

Said elastic member 64 is inserted between the supporting member 61 and the thumb wheel 63, and the elastic members maintain the thumb wheel 63 in the concentric position, and provide the capacity for the thumb wheel 63 to be moved to the eccentric position. The elastic member is composed a spring material, such as metal and resin; it can transform elastically corresponding to a change in the position of the thumb wheel and serves to restore the thumb wheel 63 to the concentric position by a force of repulsion against the transformation.

The elastic member 64 shown in the drawings is approximately rectangular in shape in the free-state and, the central portion of each side curving toward the inside, those four inside sections 64*a* are installed so as to be in contact with shaft 61*c* of said supporting member 61, and it is possible for the four arch-shaped exterior corner sections 64*b* to come into contact with the inner circumferential surface 63*a*, described hereinafter, of said thumb wheel 63.

Said thumb wheel 63 is ring-shaped and its exterior circumference is gear-shaped to provide traction for a finger, and the surface of the inside opening is formed so that the inner circumferential face 63*a* can come into contact with the exterior sections 64*b* of said elastic member 64, and the interior diameter of the inner circumferential surface 63*a* is slightly greater than the exterior diameter 64*b* of the elastic member 64, so that proper assembly is assured.

A circular concave part 63*b* having a depth equivalent to the thickness of and having a diameter larger than the external diameter of aforementioned engaging-part 65 is provided on the outer face of thumb wheel 63. A gear-type face 63*c* is formed on the inner circumferential surface of the peripheral section of concave part 63*b* for engaging with the gear-type face of the external circumference of engaging-member 65. The faces of the engaging-stopper 63*c* and the engaged-stopper 65*a* are formed so as to be gear teeth-shaped, wherein concave and convex sections are provided alternately on said faces at equal-intervals.

After the elastic member 64 and the thumb wheel 63 are installed on the outer circumference of the shaft part 61*c* of the supporting member 61, the supporting members 61 are inserted and fitted from both sides of the spark wheel 62 to assemble the ignition mechanism 6. The engaging-member 65 is inserted into the concave part 63*b* of the thumb wheel 63 and disposed on the inside of the gear-type inner circumferential surface 63*c*, and because the outer diameter of the gear-type outer-circumference face 65*a* is smaller than the inner diameter of the gear-type inner-circumference face 63*c* of the thumb wheel 63, the thumb wheel 63 can be caused to move to the concentric or eccentric position in relation to the supporting member 61 corresponding to a change caused to the shape of the elastic member 64, and the gear-type inner-circumference face 63*c* and the gear-type outer-circumference face 65*a* can engage with each other.

When the thumb wheel 63 is maintained in the concentric position by the elastic power (repellant force against deformation) of the elastic member 64, the gear-type inner-circumferential surface 63*c* and the gear-type outer-circumferential surface 65*a* of the engaging-member 65 do not engage, and the thumb wheel 63 is thereby idled. When the thumb wheel 63 is moved to the eccentric position by a change caused to the shape of the elastic member 64, the gear-type inner-circumferential surface 63*c* and the gear-type outer-circumferential surface 65*a* of the engaging-member 65 engage (as shown in FIG. 8B), rotation of the thumb wheel 63 is transferred to the support member 61 and the spark wheel 62 and they rotate as a unit.

As shown in FIG. 3, the aforementioned operating lever 5 passes between the supports 25 and extends in the front-back direction to the upper part of the inner-case 23 in the body 2. The operating lever 5 is composed of synthetic resin, the tip of the nozzle 3 is inserted through the lever 5 and the neck of the nozzle is engaged by a slit-groove composing the nozzle-engager 51 provided at one edge of the lever 5, and on the upper face of another edge is provided the pressing part 52. The nozzle-engaging part 51 is always engaged with the nozzle. The upper part of the tube 24 is inserted through the area between the nozzle-engaging part 51 and the pressing part 52, and the flint 68 is pressed against the bottom section of the outer circumference of the spark wheel 62.

The operation of the gas lighter 1 having the above described structure will now be explained. As shown in FIG. 1 to FIG. 6, FIG. 7A and FIG. 8A (depicting the not-operating state), the entire periphery of elastic member 64 is in a state in which no deforming pressure is being applied, whereby the thumb wheel 63 is maintained in the concentric position so that its center is substantially coincident with the center of the supporting member 61. In this state, the thumb wheel 63 can be simply rotated by the turn of a finger, and even under a slight amount of push-pressure from a finger, as the gear-type inner-circumferential surface 63*c* of the thumb wheel 63 and the gear-type outer-circumferential surface 65*a* of the engaging member 65 are disposed so as to be disengaged, in respective positions between which there is an open interval, the thumb wheel 63 is idled. At that time, the elastic member 64 does not rotate, and the inner-circumference of the rotating thumb wheel 63 slides over the other circumference of the elastic member 64, or the elastic member 64 rotates together with the thumb wheel 63 and its inner-circumference slides over the outer-circumference of the supporting member 61, or the elastic member 64 slides at both the peripheral and inside parts. When the thumb wheel 63 is idled, the supporting member 61 and the spark wheel 62 do not rotate, and sparks are not generated, and even if the operating lever 5 is pushed-down and the fuel gas is expelled, the gas lighter is in the non-ignite state and therefore no flame is ignited.

Figure 7A:
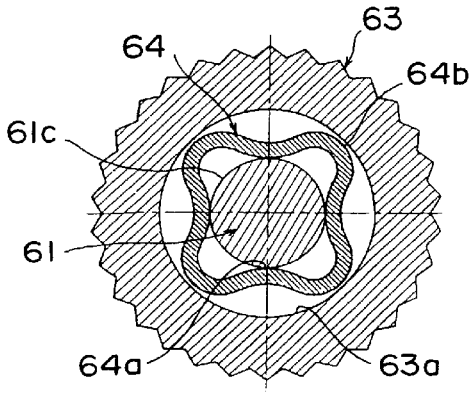
Figure 7B:
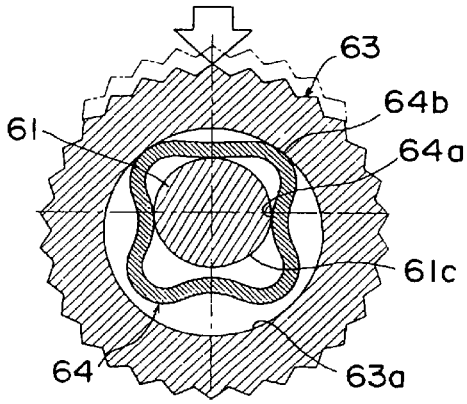
Figure 7C:
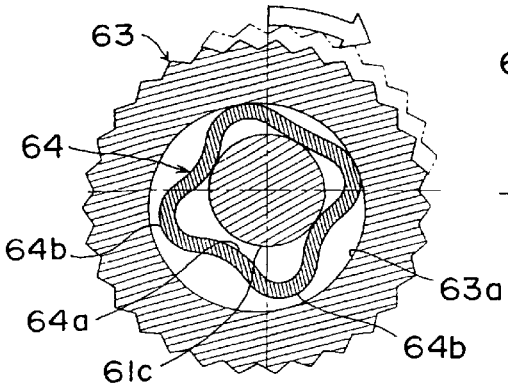
Figure 8A:
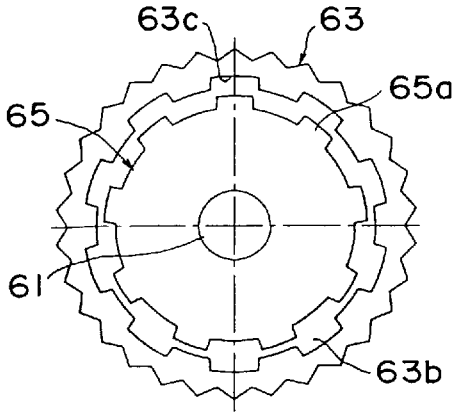
Figure 8B:
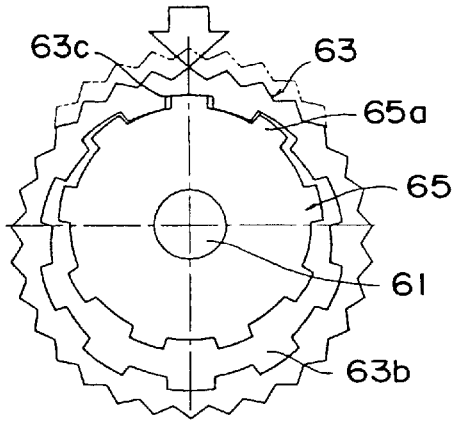
Figure 8C:
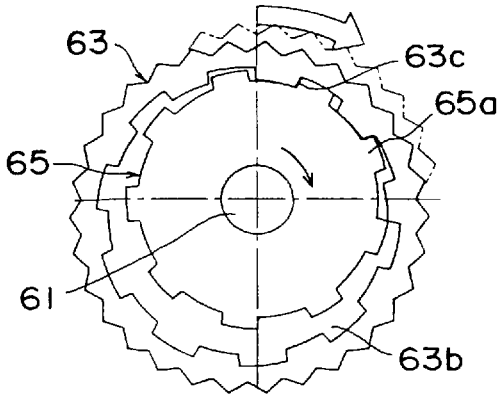

Next, the operation of the gas lighter 1 to cause ignition, as shown in FIG. 7B and FIG. 8B will be explained. After placing a finger on the serrated outer circumference of the thumb wheel 63 and applying with said finger a strong force toward the center of the thumb wheel 63, and thereby effecting the ignite-state, rotate the thumb wheel 63, then depress the pressing-part 52 of the operating-lever 5 as shown in FIG. 7C and FIG. 8C.

At first, when a strong force directed toward the center of the thumb wheel 63 is applied, a deformation of the corresponding pushed part of the elastic member 64 is caused by inside face 63*a* of the thumb wheel 63, and the thumb wheel 63 is thereby shifted to the eccentric position. As a result, the gear-type inner circumference 63*c* of the thumb wheel 63 engages the gear-type outer circumference 65*a* of the engaging-member 65 causing the ignition mechanism to be in the ignite-state. In the state, if the thumb wheel 63 is rotated, the power of said rotation is transferred to the support member 61 from the meshed interface of the gear-type inner circumference 63*c* and the gear-type outer circumference 65*a* through the engaging-member 65, whereby the spark wheel 62 rotates and sparks are generated. Continuing, the vibration of the operating-lever causes the nozzle engaging part 51 to raise the nozzle 3 causing fuel gas to be expelled from said nozzle whereupon it is ignited by said sparks.

Figure 7D:
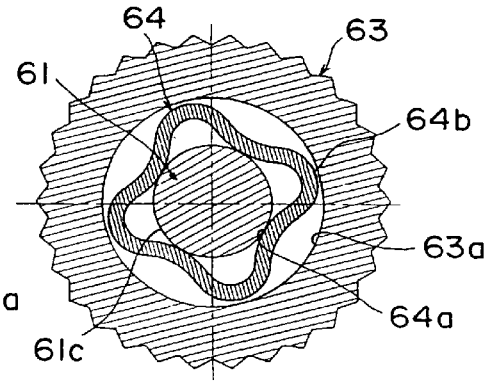

When the pressing-part 52 of the operating-lever 5 is released by a finger to extinguish the flame, the nozzle 3 is pulled down by the power of a spring installed in the fuel supply means 4, causing the spouting of the fuel gas to stop. Also, the release of the thumb wheel 63 effects recovery of the original shape of the elastic-member 64 by the repulsion force due to the deformation, as shown in FIG. 7D and FIG. 8D, and the thumb wheel 63 shifts back from the eccentric to a concentric position, the gear-type inner circumference 63*c* and the gear-type outer circumference 65*a* are disengaged and in the disengaged-state; the ignition mechanism automatically reverts to the not-ignite state wherein the thumb wheel 63 is idled.

Figure 8D:
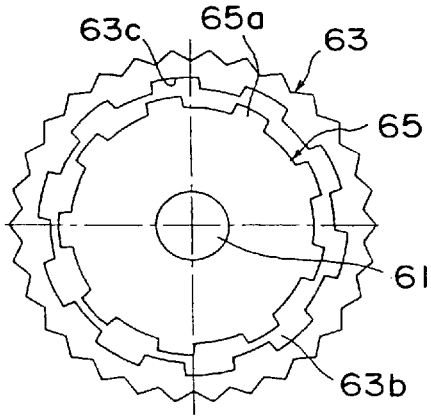

Moreover, as shown in FIG. 8D, when the thumb wheel 63 is at rest, the positions of respective gear teeth of the upper part of the gear-type inner circumference 63*c* and the gear-type outer circumference 65*a* do not match, and if even after being pushed together they do not engage directly, as shown in FIG. 8B, if the thumb wheel is pushed enough so that both surfaces are brought into contact with each other, then when of rotation of the thumb wheel 63 is first initiated, the gear-type inner circumference 63*c* and the gear-type outer circumference 65*a* mesh and are in the engage-state, wherein the spark wheel 62 can be caused to rotate.

According to the present embodiment, the thumb wheel 63 idles when operated by an ordinary rotation thereof, so sparks are not generated, whereby it is possible to realize a not-ignite state under conventional operation. In addition, because of the addition of the operational requirement of pushing the thumb wheel 63 to switch to the ignite-state to the conventional operating method, a series of operations are linked, providing outstanding operability. Moreover, through said pushing operation, the switch from the non-ignite in which the gear-type inner circumference 63*c* and the gear-type outer circumference 65*a* are not engaged state to the ignite-state, is rendered clearly distinguishable. Moreover, when the thumb wheel 63 is idled, the elastic-member 64 maintains the thumb wheel 63 in the concentric position, thereby preventing the occurrence of unseemly noise, and because the gap between the elastic member 64 and the thumb wheel 63 is small, the thumb wheel 63 is not shaky.

Figure 9A:
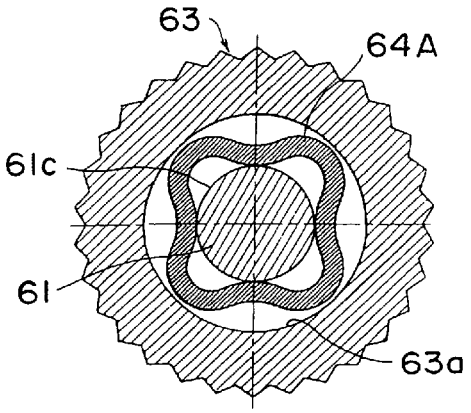
FIGS. 9A to 9E are cross-sectional views of the ignition mechanism of other embodiments having an elastic member.
Figure 9B:
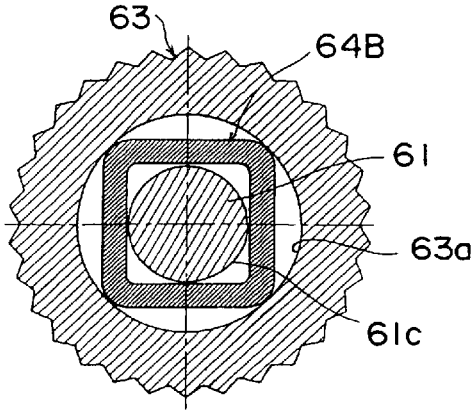
Figure 9C:
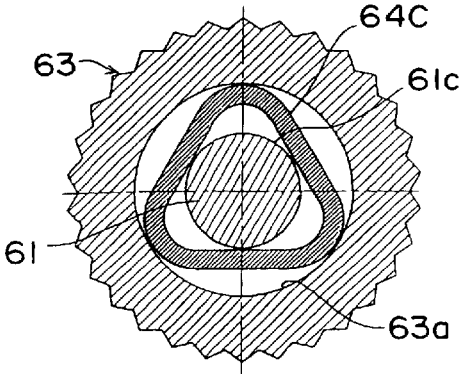
Figure 9D:
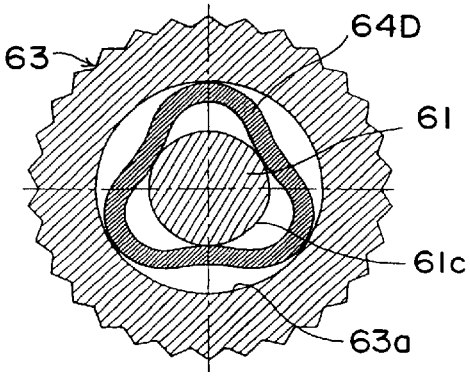

FIGS. 9A to 9E and FIGS. 10A to 10E show the elastic member according to other embodiments. FIGS. 9A to 9E are cross-sectional views of the elastic material, e.g. rubber or soft resins, according to each embodiment. The elastic member 64A shown in FIG. 9A is rectangular in shape, and is of the same type of embodiment as shown in FIG. 5 and FIGS. 7A to 7D, wherein the center section of the sides arch toward the inside so that the inner surfaces thereof are in contact with the surface of shaft 61*c* of the supporting member 61, and the four outer points of the arch shaped portions are proximal to the inner-circumferential surface 63*a* of the thumb wheel 63. The elastic member 64B shown in FIG. 9B is rectangular in shape and has 4 straight sides, the central inner surfaces of which are in contact with the surface of the shaft 61*c* of the supporting-member 61, and four corners projecting so as to be proximal to the inner-circumferential surface 63*a* of the thumb wheel 63. The elastic member 64*c* shown in FIG. 9C is triangular in shape and has three straight sides, the central inner surfaces of which are in contact with the shaft 61*c* of the supporting member 61, and three corners projecting so as to be proximal to the inner-circumferential surface 63*a* of the thumb wheel 63. The elastic member 64D shown in FIG. 9D is approximately triangular in shape, and the center sections of the three sides arch toward the inside so that the inner surfaces thereof are in contact with the shaft 61*c* of the supporting member 61, and the outer surfaces of the three corners are proximal to the inner-circumferential surface 63*a* of the thumb wheel 63.

Figure 9E:
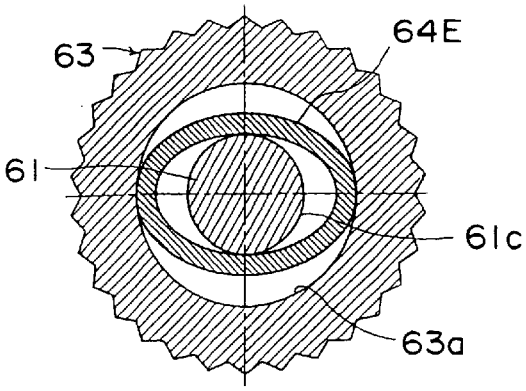

The elastic member 64E shown in FIG. 9E is elliptical in shape, both of the inside surfaces on the short axis being in contact with the face of the shaft 61*c* of the supporting member 61, and both of the other surfaces of the two projecting ends on the long axis being proximal to the inner circumferential surface 63*a* of the thumb wheel 63. These elastic members 64A to 64E composed of elastic material, are formed having a certain thickness for the provision of adequate elastic power to effect the recovery of the thumb wheel 63 to the concentric position.

Figure 10A:
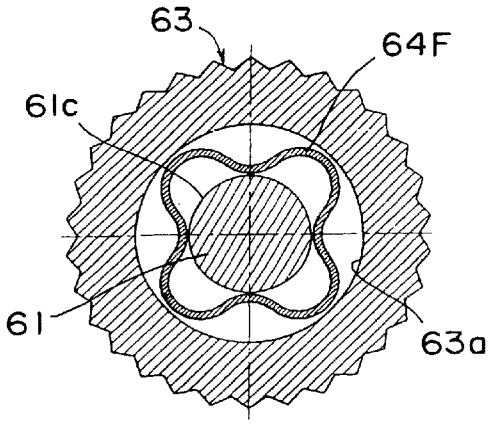
FIGS. 10A to 10E are cross-sectional views of the ignition mechanism of yet another embodiment having an elastic member.
Figure 10B:
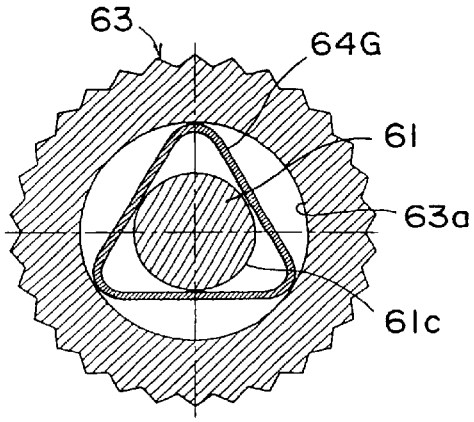
Figure 10C:
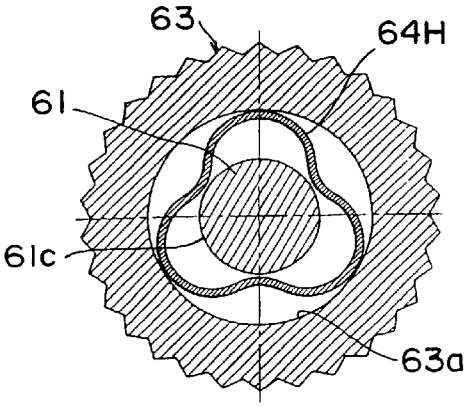
Figure 10D:
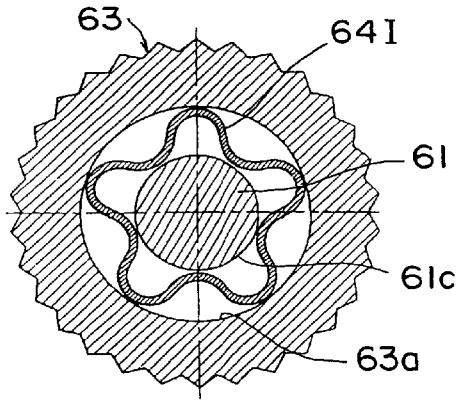
Figure 10E:
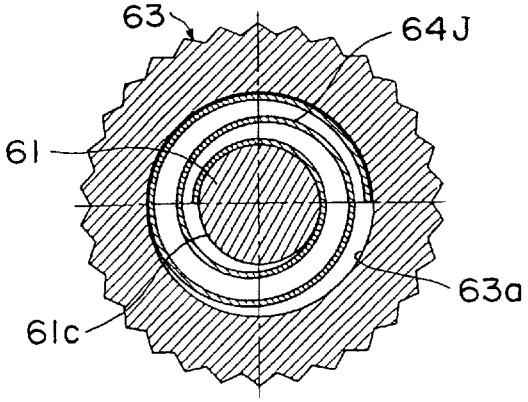

FIGS. 10A to 10E are cross-sectional views of embodiments utilizing spring material, e.g. metal and resin. The elastic member 64F shown in FIG. 10A is substantially rectangular in shape and thin, and the central inner surfaces of the sides arch toward the interior thereof so as to be in contact with the surface of shaft 61*c* of the supporting member 61, and the outer surfaces of the four corners are proximal to the inner-circumferential surface 63*a* of the thumb wheel 63. The elastic member 64G shown in FIG. 10B, is triangular in shape and has three straight sides, the central inner surfaces of which are in contact with the shaft 61*c* of the supporting member 61, and three projecting corners whose outer surfaces are proximal to the inner-circumferential surface 63*a* of the thumb wheel 63. The elastic member 64H shown in FIG. 10C, is substantially triangular in shape, and has three straight sides, the central inner surfaces of which are in contact with the shaft 61*c* of the supporting member 61, and three projecting corners whose outer surfaces are proximal to the inner-circumferential surface 63*a* of the thumb wheel 63. The elastic member 64I shown in FIG. 10D is substantially pentagonal in shape, and has five sides whose central inner surfaces arch toward the interior thereof so that they are in contact with the surface of shaft 61*c* of the supporting member 61, and five corners whose outer surfaces are proximal to the inner-circumference face 63*a* of the thumb wheel 63. The elastic member 64J shown in FIG. 10E is spiral in shape, and has an inner surface greater than that of a semicircle in contact with the surface of the shaft 61*c* of the thumb wheel 61, and an outer surface greater than that of a semicircle proximal to the inner-circumference face 63*a* of the thumb wheel 63. The elastic members 64F to 64J composed of spring materials are formed having a certain thinness for provision of adequate elastic power to effect recovery of the thumb wheel 63 to the concentric position.

When an elastic members 64A to 64J is mounted to the supporting member 61, the outside diameter of said elastic member is smaller than the inside diameter of the inner circumferential surface of the thumb wheel 63, and there is a gap between the elastic member and the thumb wheel, so it is easy to assemble. Also, the materials of which elastic members are to be composed as well as their shapes are changeable corresponding to design.

Figure 11:
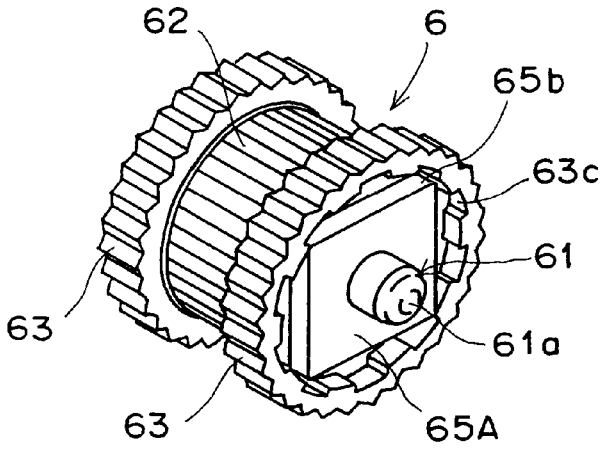
FIG. 11 is a perspective view of another embodiment of the ignition mechanism.
Figure 12:
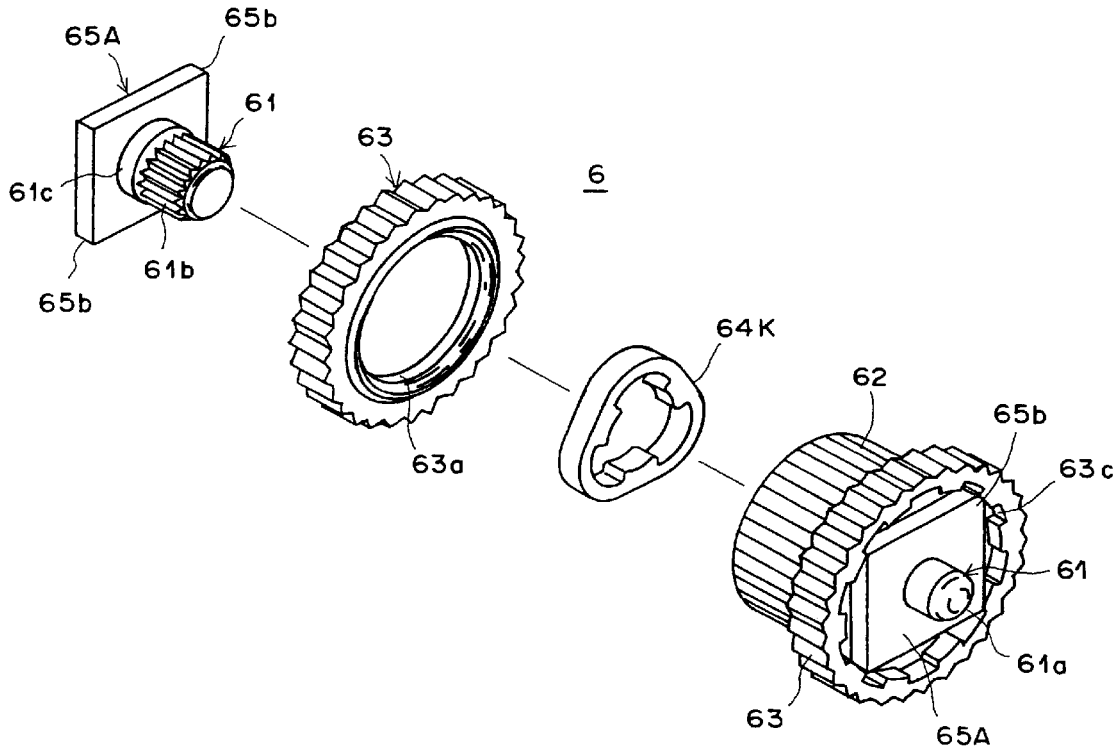
FIG. 12 is an exploded perspective view of the embodiment of FIG. 11.

FIG. 11 is a perspective view of another embodiment of the ignition mechanism; FIG. 12 is an exploded perspective view thereof; FIG. 13 shows a side view thereof. The ignition mechanism according to this embodiment is equipped with a rectangular (polygonal) engaging member 65A. In other respects, it is constituted the same as those of FIGS. 4–6. The aforementioned rectangular engaging member 65A is formed integrally on support member 61 on both sides, and the four corners of this rectangular engaging member 65A are provided as engagement stoppers 65*b*. Engagement is made possible between the engagement stoppers 65*b* and engagement stoppers 63*c* of thumb wheel 63. Note that the elastic member 64K which is disposed within the inner circumference of thumb wheel 63 is of an approximate triangular shape when in a free state.

FIG. 14 shows a side sectional view of yet another embodiment of an ignition mechanism. The ignition mechanism 6 according to this embodiment is equipped with a triangular engaging member. The three corners on the outer periphery of this engaging member 65B are provided as engagement stoppers 65*c*. Engagement is made possible between said engagement stoppers 65*c* and engagement stoppers 63*c* of thumb wheel 63.

Figure 15:
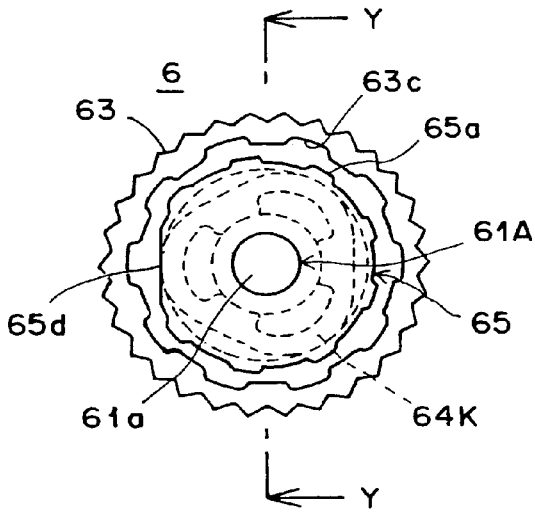
FIG. 15 shows a side view of another embodiment of an ignition mechanism.
Figure 16:
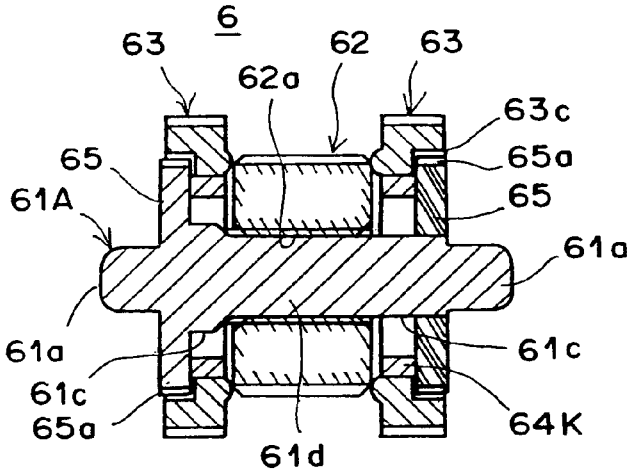
FIG. 16 is a cross-sectional view taken along the line Y—Y of FIG. 15.

FIG. 15 shows a side view of another embodiment of an ignition mechanism; FIG. 16 is a cross-sectional view thereof taken along the line Y—Y of FIG. 15. The ignition mechanism 6 according to this embodiment is equipped with a support member 61A of the penetrative type. In other respects, it is constituted the same as those of FIGS. 4 to 6. The aforementioned support member 61A is integrally formed with disk-shaped engaging member 65, which is adjacent on one side to the rotation shaft 61*a*. Note that one part of the gears on the outer periphery of engaging member is removed, and a position determining base plane 65*d* is formed. The shaft-shaped conjoining part 61*d* of the aforementioned support member 61A mates with and penetrates through central hole 62*a* in the thumb wheel 63 of one side and the spark wheel 62; further, it penetrates the thumb wheel on the other side, and the engaging member 65 of the other side is secured thereon; rotating shaft 61A projects from the tip thereof.

FIG. 17 is a central sectional view of still another embodiment of the ignition mechanism, and FIG. 18 is an exploded perspective view thereof. The ignition mechanism of this embodiment is equipped with elastic members 64K on the outsides of engaging members 65 on both sides. In other respects, it is constructed the same as that of FIGS. 4 to 6. On the support member 61B on both sides, a disk-shaped engaging member 65 is formed, between the shaft-shaped conjoining part 61*b* and shaft 61*c*. That is to say, the shaft-shaped conjoining members 61*b* which are to be mated with the central aperture 62*a* of spark wheel 62 projects from the center of the inner sides of engaging members 65 of support member 61B on both sides; shafts 61*c*, on whose outer periphery are mounted elastic members 64K, are mounted on the center of the outer sides of said engaging members 65; and rotation shafts 61*a* project from the tips of support members 61B. Thumb wheels 63A are installed in an orientation flipped inside out in relation to that of FIG. 4; on the outer sides thereof are formed inner circumferential surfaces 63*a* for contacting the outer peripheries of elastic members 64K; on the inner sides thereof are formed recesses 63*b* which receive engaging member 65, as well as engagement stoppers 63*c*. Then, the aforementioned elastic members 64K are installed on the outer sides of thumb wheels 63A, and engaging members 65 are installed on the inner sides thereof. Further, FIGS. 19A to 19F are side views showing spark wheels 62A~62F of other embodiments. These spark wheels 62A~62F have a portion of their teeth 62*b* removed, thereby reducing excess friction with aforementioned flint 68. In the spark wheel 62*a* of FIG. 19A, 1 tooth 62*b*; in the spark wheel 62*b* of FIG. 19B, 2 teeth 62*b*; in the spark wheel 62*c* of FIG. 19C, 4 teeth 62*b*; in the spark wheel 62*d* of FIG. 19D, 6 teeth 62*b*; in the spark wheel 62*e* of FIG. 19E, 18 teeth 62*b*; and in the spark wheel 62F of FIG. 19F, 18 teeth 62*b* are removed, respectively.

What is claimed is:

1. An ignition mechanism for a gas lighter that generates sparks upon rotation of a spark wheel against which a flint is held under pressure thereby comprising:

a shaft-shaped support member rotatably installed in the body of a lighter, a spark wheel that can rotate with said supporting member as a unit, an elastic member installed around the shaft of said support member on at least one side of said spark wheel, a thumb wheel having a gear-type interior face installed around the exterior circumference of said elastic member so that said thumb wheel can idle, and so that it can be caused to be in the concentric or eccentric position in relation to said support member in response to a change in the shape of said elastic member, disk-shaped engaging-member that can rotate as a unit with said support member installed inside engaging-stopper of said thumb wheel, wherein said disk-shaped engaging-member having a gear-type exterior-circumference which can engage with the gear-type exterior-circumference which can engage with the gear-type interior face of the surrounding thumb wheel, being of a smaller size than said gear-type interior face of said thumb wheel when said thumb wheel is moved to the eccentric position, wherein, when said thumb wheel is maintained in the concentric position in relation to said supporting member by the elastic force of said elastic member, the gear-type interior face thereof is not engaged with the gear-type exterior circumference of said disk-shaped engaging member whereby said thumb wheel is idled, and said thumb wheel is switched to the eccentric position in response to a deformation of the elastic-member, whereby said spark wheel can be caused to rotate, while the gear-type inner face of said thumb wheel and the gear-type outer face of said disk-shaped engaging member are engage, by rotation of said thumb wheel.

2. An ignition mechanism according to claim 1, wherein said support member comprises a conjoining part which is fitted in and fixed from both sides to the center of said spark wheel, and a shaft part on whose circumference said elastic member is installed, and which is adjacent and contiguous to said conjugation part.

3. An ignition mechanism according to claim 1, wherein said support member is constituted so that on one side the engaging member is integrally formed therewith, which then penetrates through the spark wheel and thumb wheel, and the engaging member on the other side is secured to the other end thereof.

4. An ignition mechanism according to any one of claims 1, 2, or 3, wherein said elastic member is installed on the outer side of said engaging member.

5. An ignition mechanism according to claim 1, wherein said engaging member is integrally formed with said support member, and said elastic member is installed between said engaging member and the side face of said spark wheel.

6. An ignition mechanism according to claim 1, wherein said engaging member is inserted into the concave section having a greater diameter than said engaging member formed on the side of said thumb wheel, and said gear-type interior face is formed on inside face of peripheral part of said concave part.

7. An ignition mechanism according to claim 1, wherein the interior circumferential surface of said elastic member is in contact with said support member and the exterior circumferential surface of said elastic member can be caused to be in contact with the interior circumferential surface of said thumb wheel, said elastic member being composed of an elastic material, rubber or soft resin.

8. An ignition mechanism according to claim 1, wherein the interior circumferential surface of said elastic member is in contact with said support member and the exterior circumferential surface of said elastic member can be caused to come in contact with the interior face of said thumb wheel, said elastic member being composed of spring material, metal or resin.

* * * * *

UNITED STATES PATENT AND TRADEMARK OFFICE

CERTIFICATE OF CORRECTION

PATENT NO. : 6,551,096 B2
DATED : April 22, 2003
INVENTOR(S) : Saito et al.

It is certified that error appears in the above-identified patent and that said Letters Patent is hereby corrected as shown below:

Column 2,
Line 36, “A” should be deleted

Column 3,
Line 21, “to” should be deleted
Line 29, “surity” should read -- surety --

Figure 13A:
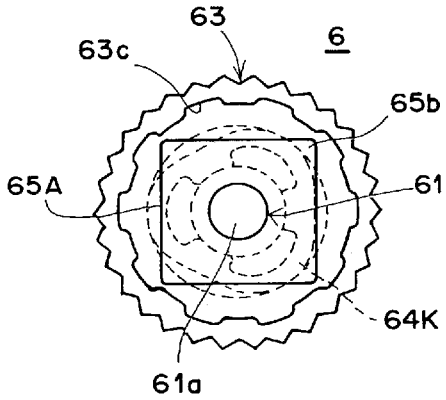
FIG. 13 is a side view of the embodiment of FIG. 11.
Figure 13B:
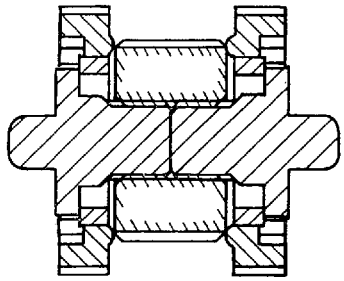
Figure 14A:
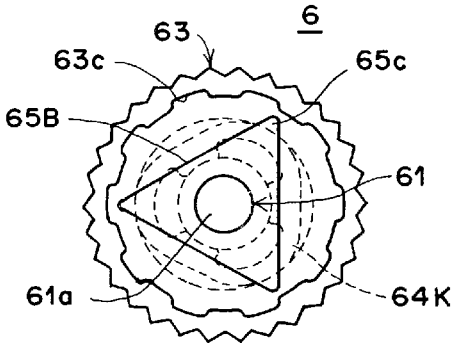
FIG. 14 is a side sectional view of yet another embodiment of an ignition mechanism.
Figure 14B:
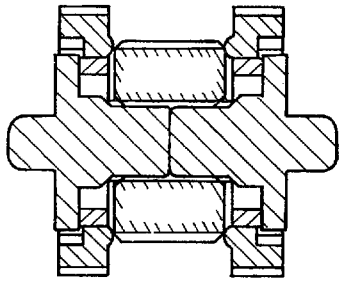
Figure 17A:
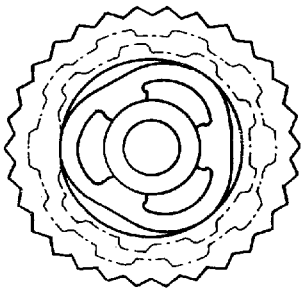
FIG. 17 is a central sectional view of still another embodiment of the ignition mechanism.
Figure 17B:
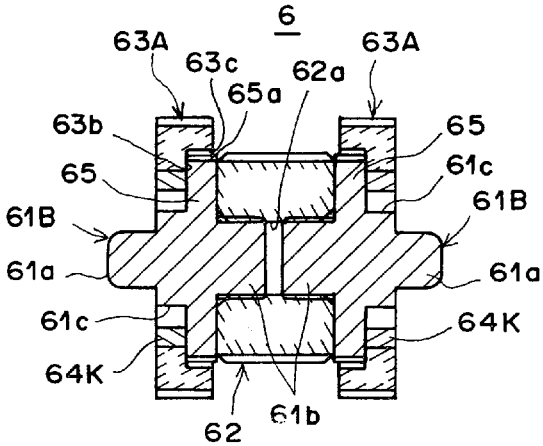
Figures 18A, 18B:
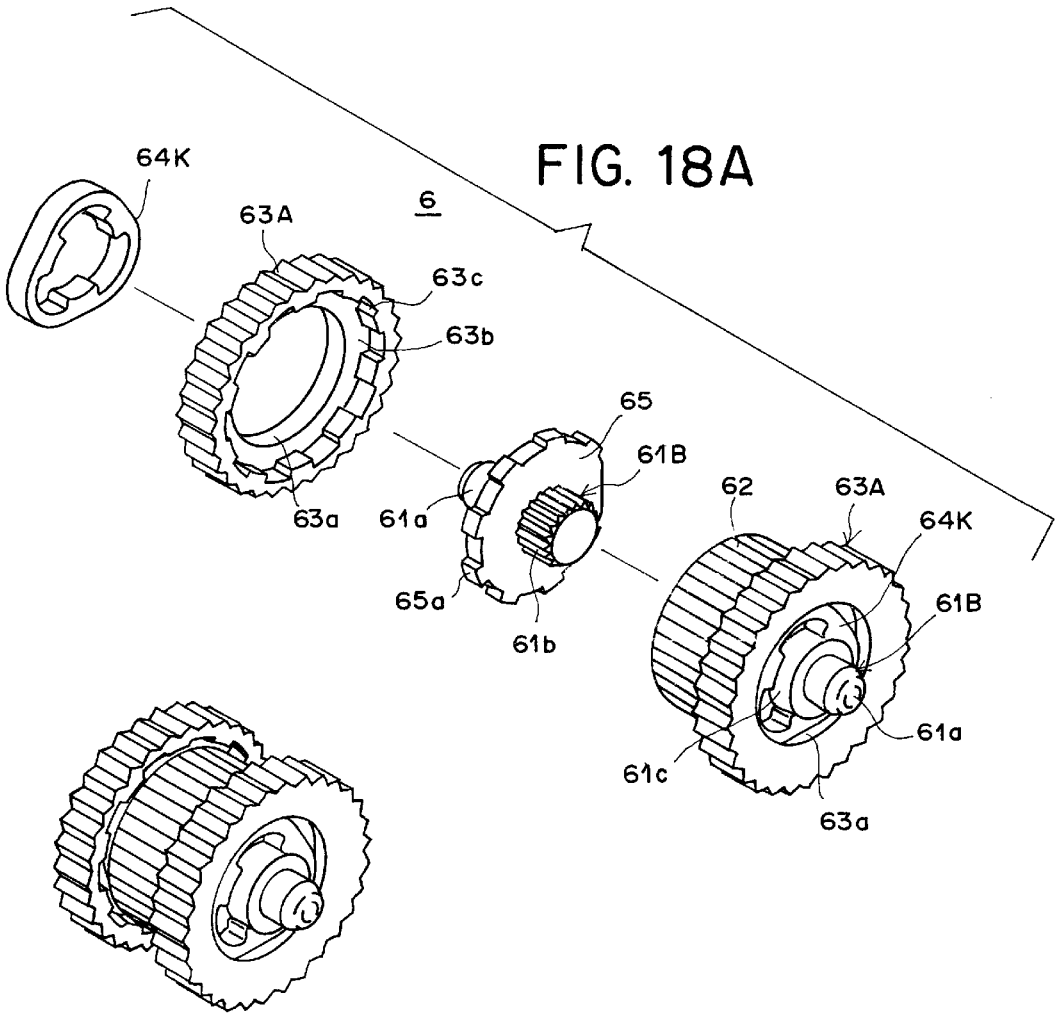
FIG. 18 is an exploded perspective view of the embodiment of FIG. 17, and FIGS. 19A to 19F are side views showing spark wheels of other embodiments.
Figure 19A:
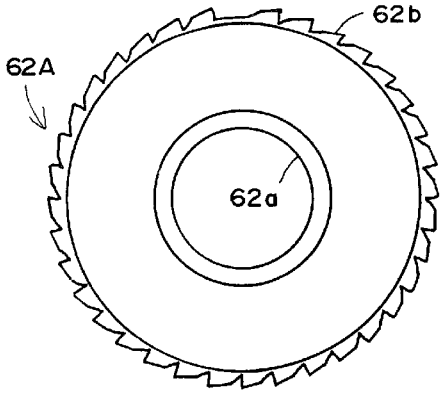
Figure 19B:
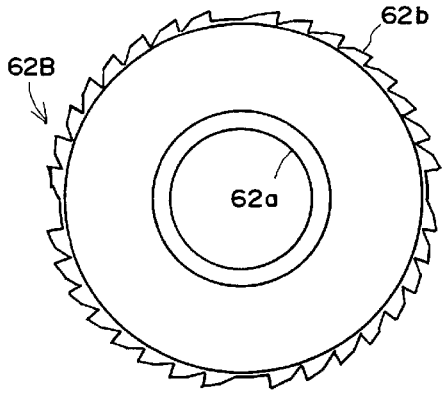
Figure 19C:
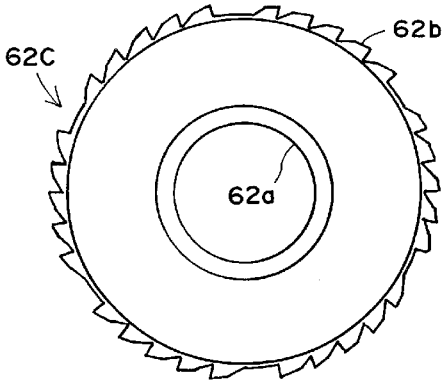
Figure 19D:
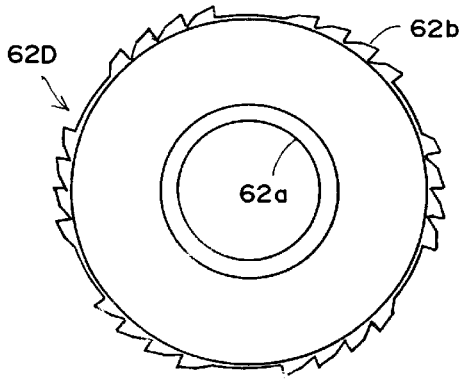
Figure 19E:
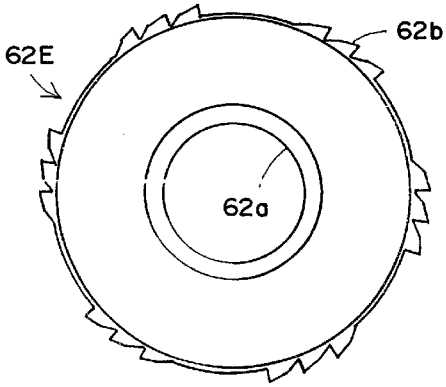
Figure 19F:
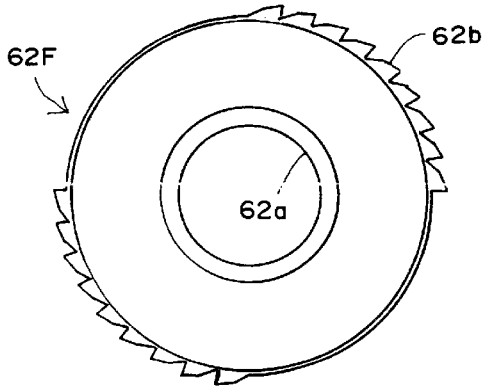

Column 4,
Line 3, “FIG. 13 is a side view” should read -- FIGS. 13A and 13B are side views --
Line 4, “FIG. 14 is a side sectional view” should read -- FIGS. 14A and 14B are side sectional views --
Line 10, “FIG. 17 is a” should read -- FIGS. 17A and 17B are --; and
“view” should read -- views --
Line 12, “FIG. 18 is” should read -- FIGS. 18A and 18B are --; and
“view” should read -- views --
Line 14, “FIG. 17,” should read -- FIGS. 17A and 17B, --

Column 5,
Line 12, “conjugation” should read -- conjoining --
Line 64, “equal-intervals” should read -- equal intervals --

Column 6,
Line 58, “other” should read -- outer --
Line 65, “pushed-down” should read -- pushed down --

Column 7,
Line 46, “of” (first occurrence) should be deleted
Line 55, “to” (third occurrence) should be deleted
Line 59, “ignite” should read -- ignite state --
Line 60, “state” should be deleted

UNITED STATES PATENT AND TRADEMARK OFFICE

CERTIFICATE OF CORRECTION

PATENT NO. : 6,551,096 B2
DATED : April 22, 2003
INVENTOR(S) : Saito et al.

It is certified that error appears in the above-identified patent and that said Letters Patent is hereby corrected as shown below:

Column 9,
Line 8, “members” should read -- member --
Line 18, “FIG. 13 shows” should read -- FIGS. 13A and 13B show --
Line 31, “FIG. 14 shows” should read -- FIGS. 14A and 14B show --
Line 58, “FIG. 17 is a” should read -- FIGS. 17A and 17B are --; and “view” should read -- views --
Line 59, “FIG. 18” should read -- FIG. 18A --

Column 10,
Line 29, “supporting” should read -- support --
Lines 36, 46, 47, 49, 50, 56, 57, 62 and 63, “gear-type” should read -- gear --
Line 37, “the” should read -- an --
Line 39, “the” should read -- a --
Line 42, “disk-shaped” should read -- a disk-shaped --
Line 42, “engaging-member” should read -- engaging member --
Line 43, before “engaging-” insert -- an --
Line 43, “engaging-” should read -- engaging --
Line 46, “engaging-member” should read -- engaging member --; and “exterior-” should read -- exterior --
Line 48, delete entire line
Line 51, “when said thumb wheel is moved” should be deleted
Line 52, “to the eccentric position” should be deleted
Line 54, “supporting” should read -- support --
Line 60, “elastic-” should read -- elastic --
Line 64, “engage,” should read -- engaged, --

Column 11,
Line 4, “conjugation” should read -- conjoining --
Line 7, “which” should read -- said support member --
Line 9, “the” (first occurrence) should read -- another --
Line 12, “the” should read -- an --
Line 17, “the” should read -- a --

UNITED STATES PATENT AND TRADEMARK OFFICE

CERTIFICATE OF CORRECTION

PATENT NO. : 6,551,096 B2
DATED : April 22, 2003
INVENTOR(S) : Saito et al.

It is certified that error appears in the above-identified patent and that said Letters Patent is hereby corrected as shown below:

Column 12,
Line 1, “gear-type” should read -- gear --
Line 2, “on inside” should read -- on an inside --
Line 3, “part.” should read -- section. --
Lines 5 and 12, “the” should read -- an --
Line 8, “circumferential surface” should read -- face --

Signed and Sealed this

Seventh Day of October, 2003

JAMES E. ROGAN
*Director of the United States Patent and Trademark Office*